US008127677B2

(12) United States Patent
Fujishiro

(10) Patent No.: US 8,127,677 B2
(45) Date of Patent: Mar. 6, 2012

(54) PLATE INSERTING APPARATUS INCLUDING BRAKING UNIT FOR BRAKING THE PLATE

(75) Inventor: Shinichi Fujishiro, Chiba (JP)

(73) Assignee: Komori Corporation, Tokyo (JP)

( * ) Notice: Subject to any disclaimer, the term of this patent is extended or adjusted under 35 U.S.C. 154(b) by 155 days.

(21) Appl. No.: 12/389,231

(22) Filed: Feb. 19, 2009

(65) Prior Publication Data

US 2009/0205525 A1 Aug. 20, 2009

(30) Foreign Application Priority Data

Feb. 20, 2008 (JP) ..... 2008-039191

(51) Int. Cl.
*B41F 27/12* (2006.01)

(52) U.S. Cl. ..... 101/477; 101/479; 101/415.1

(58) Field of Classification Search ..... 101/477, 101/479, 480, 415.1
See application file for complete search history.

(56) References Cited

U.S. PATENT DOCUMENTS 4,844,444 A 7/1989 Kato
5,511,478 A 4/1996 Lindner et al.
5,595,120 A * 1/1997 Metrope ..... 101/477
6,053,105 A * 4/2000 Rudzewitz ..... 101/477
6,345,575 B1 * 2/2002 Metrope ..... 101/415.1
2006/0174784 A1 * 8/2006 Zink ..... 101/34
2007/0006759 A1 1/2007 Fujishiro et al.

FOREIGN PATENT DOCUMENTS

DE 19934271 5/2000
WO WO 2004/020202 3/2004

* cited by examiner

*Primary Examiner* — Leslie J Evanisko
(74) *Attorney, Agent, or Firm* — Blakely, Sokoloff, Taylor & Zafman

(57) ABSTRACT

A plate inserting apparatus includes a plate cylinder, press roller, and braking unit. A plate is to be mounted on the outer surface of the plate cylinder. The press roller is rotatably supported to oppose the outer surface of the plate cylinder. When the leading edge bent portion of the plate to be supplied to the plate cylinder abuts against the press roller and the distal end of the leading edge bent portion abuts against the outer surface of the plate cylinder, the press roller inserts the leading edge bent portion of the plate into a groove portion formed in the plate cylinder upon rotation (with a pressing force) of the plate cylinder. The braking unit keeps braking the plate at least since the leading edge bent portion of the plate abuts against the outer surface of the press roller and until the leading edge bent portion is completely inserted in the groove portion of the plate cylinder.

9 Claims, 14 Drawing Sheets

PLATE INSERTING APPARATUS INCLUDING BRAKING UNIT FOR BRAKING THE PLATE

BACKGROUND OF THE INVENTION

The present invention relates to a plate inserting apparatus for inserting the leading edge bent portion of a new plate into the groove portion of a plate cylinder.

As described in U.S. Pre-Grant Publication No. 2007/0006759, a conventional plate inserting apparatus includes a press roller which is rotatably supported to be able to come close to and separate from the outer surface of a plate cylinder and which inserts the leading edge bent portion of a new plate into a groove portion formed in the outer surface of the plate cylinder, an air cylinder which presses the press roller against the outer surface of the plate cylinder, and a switch provided to the air cylinder. When the leading edge bent portion of a new plate cannot be inserted in the groove portion of the plate cylinder and the new plate floats from the outer surface of the plate cylinder, the switch detects this abnormality.

In the conventional plate inserting apparatus described above, the switch detects the abnormality that the leading edge bent portion of the new plate cannot be inserted in the groove portion of the plate cylinder. The leading edge bent portion that cannot be inserted in the groove portion may, however, undesirably be caught between the plate cylinder and press roller and be crushed. The new plate with the crushed leading edge bent portion can no longer be used, which is uneconomical. Also, another new plate must be remounted in a plate changing device, leading to poor working efficiency.

SUMMARY OF THE INVENTION

It is an object of the present invention to provide a plate inserting apparatus in which a plate will not be wasted, thus improving economic efficiency.

It is another object of the present invention to provide a plate inserting apparatus in which remounting of a new plate in a plate changing device is prevented, thus improving working efficiency.

In order to achieve the above objects, according to the present invention, there is provided a plate inserting apparatus comprising a plate cylinder with an outer surface where a plate is to be mounted, a press roller which is rotatably supported to oppose the outer surface of the plate cylinder and, when a leading edge bent portion of the plate to be supplied to the plate cylinder abuts against the press roller and a distal end of the leading edge bent portion abuts against the outer surface of the plate cylinder, inserts the leading edge bent portion of the plate into a groove portion formed in the plate cylinder upon rotation (with a pressing force) of the plate cylinder, and a braking unit which keeps braking the plate at least since the leading edge bent portion of the plate abuts against the outer surface of the press roller until the leading edge bent portion is completely inserted in the groove portion of the plate cylinder.

DESCRIPTION OF THE PREFERRED EMBODIMENT

The arrangement of a plate changing device for a perfector according to an embodiment of the present invention will be described hereinafter with reference to FIGS. 1 to 4.

Figure 1:
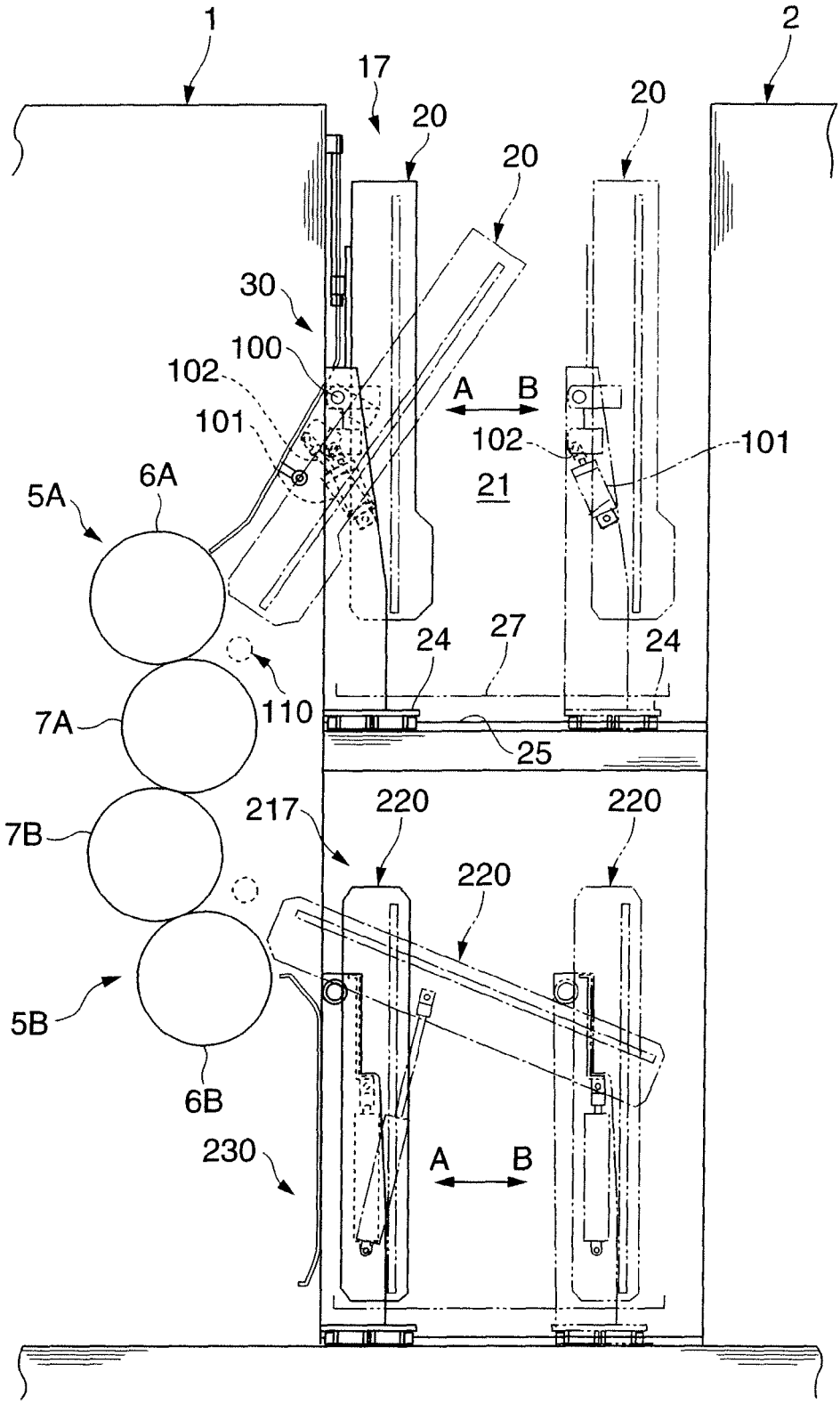
FIG. 1 is a side view showing the schematic arrangement of a perfector including plate changing devices according to an embodiment of the present invention.

As shown in FIG. 1, each of printing units 1 and 2 includes, between a pair of frames 3 and 4 (FIG. 2), an upper printing unit 5A which prints the obverse of a printing product and a lower printing unit 5B which prints the reverse of the printing product (the inside of the printing unit 2 will not be illustrated). The upper printing unit 5A includes an upper plate cylinder 6A and an upper blanket cylinder 7A which opposes the upper plate cylinder 6A. The lower printing unit 5B includes a lower plate cylinder 6B and a lower blanket cylinder 7B which opposes the lower plate cylinder 6B. The upper blanket cylinder 7A and lower blanket cylinder 7B oppose each other. A printing target product such as a web passes between the blanket cylinders 7A and 7B.

An ink supply unit (not shown) and dampening unit (not shown) supply ink and dampening water, respectively, to each of the plate cylinders 6A and 6B, and ink portions corresponding to the patterns of plates mounted on the outer surfaces of the plate cylinders 6A and 6B are transferred to the blanket cylinders 7A and 7B, respectively. Thus, the patterns are printed on the two surfaces of the printing target product passing between the blanket cylinders 7A and 7B.

The upper printing unit 5A and lower printing unit 5B further include an upper plate changing device 17 and lower plate changing device 217, respectively. The upper plate changing device 17 removes an old plate mounted on the upper plate cylinder 6A and delivers it to an upper plate removal/recovery unit 30, and supplies a new plate stored in an upper loader 20 to the upper plate cylinder 6A. The lower plate changing device 217 removes an old plate mounted on the lower plate cylinder 6B and delivers it to a lower plate removal/recovery unit 230, and supplies a new plate stored in a lower loader 220 to the lower plate cylinder 6B. The lower plate changing device 217 is not particularly different from the upper plate changing device 17. Accordingly, a description will be made on the upper plate changing device 17 hereinafter.

[Upper Plate Changing Device]

The upper plate changing device 17 includes the upper plate removal/recovery unit 30 fixed to the frames 3 and 4, and the upper loader 20 which guides the old plate removed from the upper plate cylinder 6A to the upper plate removal/recovery unit 30 and supplies the new plate to the upper plate cylinder 6A.

As shown in FIG. 1, the upper loader 20 is supported by a pair of outer frames 22 and 23 (FIG. 2) to be swingable between a standby position (a position indicated by a solid line in FIG. 1) almost perpendicular to the web convey direction (the direction of arrows A and B) and a plate supply position (a position indicated by an alternate long and short dashed line in FIG. 1) where the upper loader 20 is tilted from the standby position. At the plate supply position, the lower end of the upper loader 20 is close to the outer surface of the upper plate cylinder 6A so that the new plate in the upper loader 20 can be supplied to the upper plate cylinder 6A.

Figure 2:
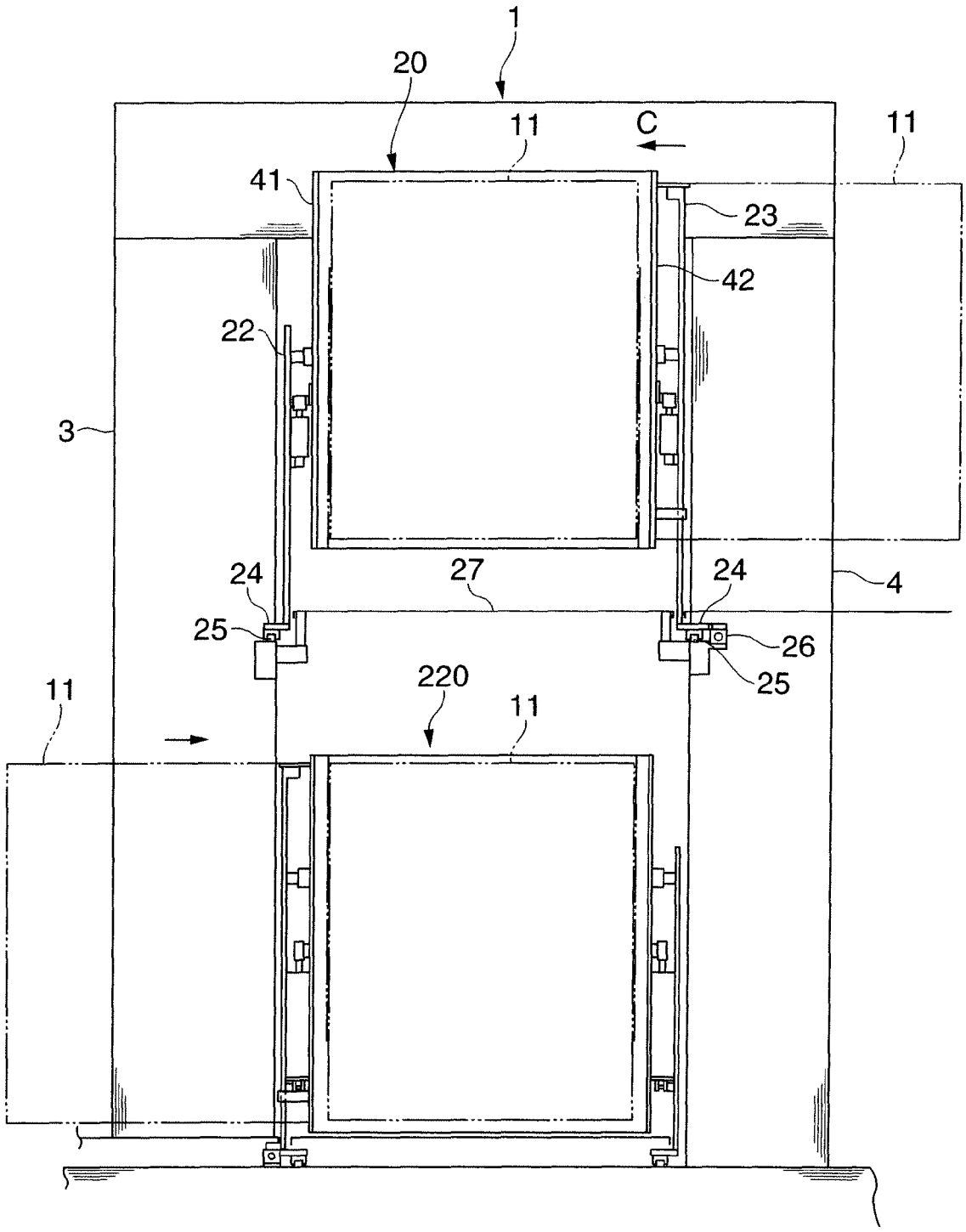
FIG. 2 is a front view of a printing unit shown in FIG. 1.

As shown in FIG. 2, the pair of outer frames 22 and 23 vertically extend on a pair of bases 24, respectively, to oppose each other. A pair of rails 25 extending in the direction of the arrows A and B are fixed to the pair of frames 3 and 4, respectively. The bases 24 are supported on the respective rails 25 to be movable in the direction of the arrows A and B. A rodless air cylinder 26 fixed to the frame 4 and extending in the direction of the arrows A and B moves the bases 24 in the direction of the arrows A and B.

Thus, the upper loader 20 also can move from the standby position indicated by the solid line in FIG. 1 through a working space 21 formed between the adjacent printing units 1 and 2 to a separate position indicated by an alternate long and two short dashed line which is close to the printing unit 2. Under the working space 21, a step 27 is horizontally fixed to the pair of frames 3 and 4 through support members.

As shown in FIG. 1, the lower end of the upper plate removal/recovery unit 30 has an opening close to the outer surface of the upper plate cylinder 6A. The old plate (not shown) removed from the upper plate cylinder 6A moves upward through this opening and is recovered in the upper plate removal/recovery unit 30.

[Upper Loader]

Figure 3:
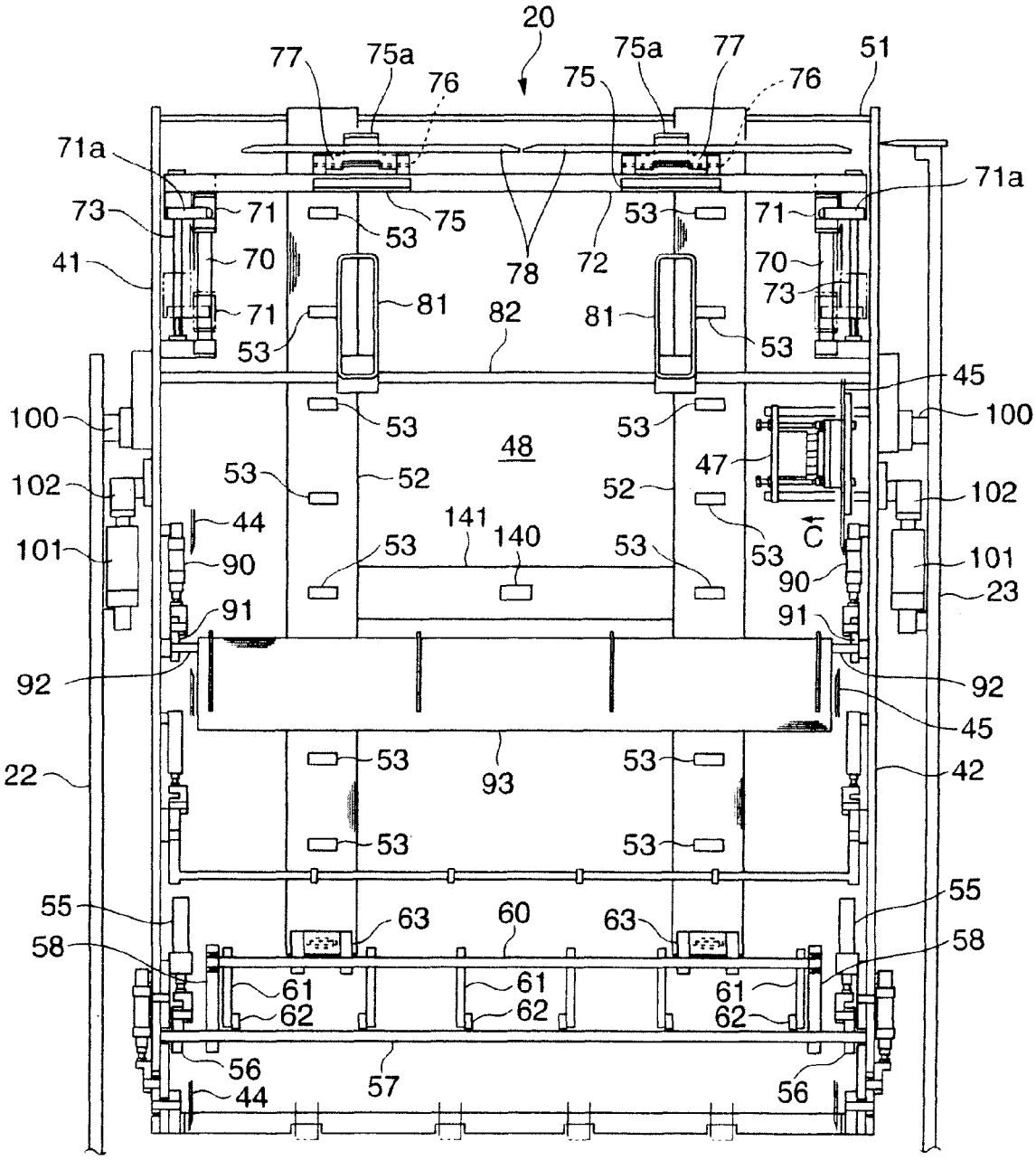
FIG. 3 is a developed front view of an upper loader shown in FIG. 2.
Figure 4:
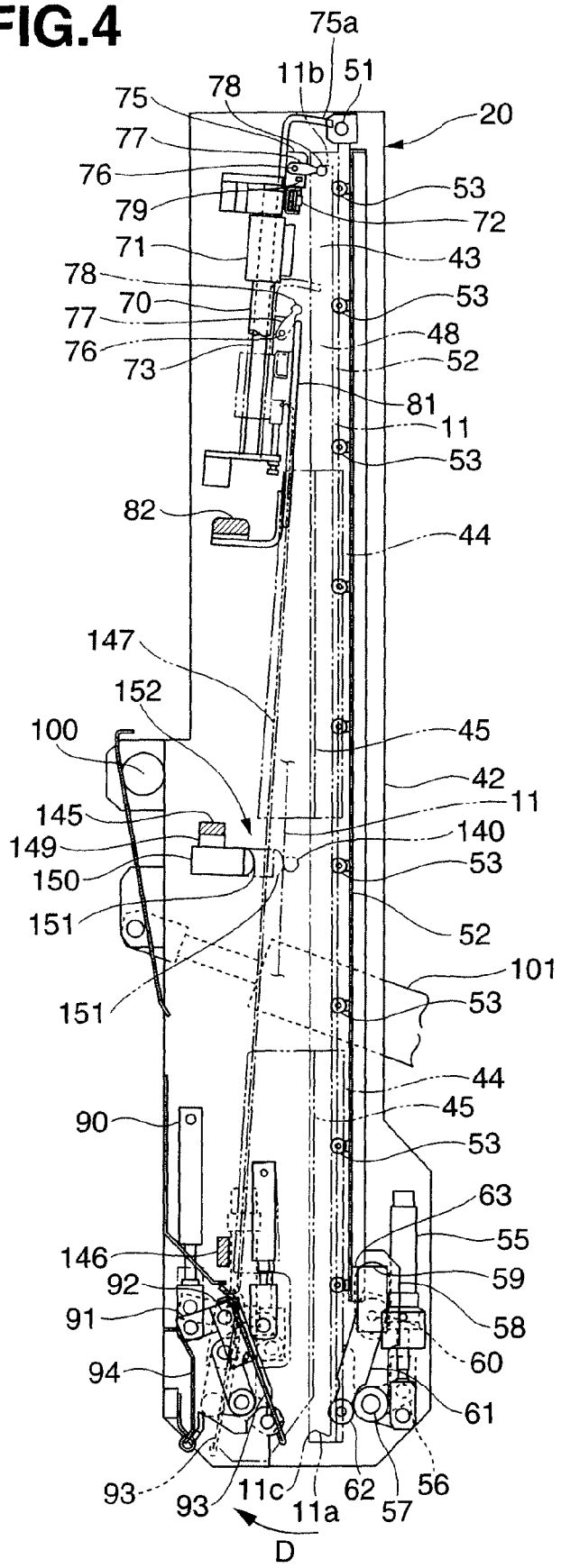
FIG. 4 is a side view showing the schematic arrangement of the upper loader shown in FIG. 2.

As shown in FIG. 3, the upper loader 20 includes a pair of inner frames 41 and 42 which oppose each other at a gap larger than the width of the new plate. As shown in FIG. 4, the inner frame 42 has a narrow slit-like elongated hole 43 to insert the new plate. As shown in FIG. 3, a flat plate-like regulating member 44 is fixed inside the inner frame 41 to be parallel to the inner frame 41. One side end of a new plate 11 inserted from the elongated hole 43 abuts against the regulating member 44.

A flat plate-like regulating member 45 opposing the regulating member 44 is provided inside the inner frame 42. As shown in FIG. 4, the width of the regulating member 45 is smaller than that of the regulating member 44 by an amount corresponding to the width of the elongated hole 43, so the regulating member 45 will not regulate insertion of the new plate 11 inserted from the elongated hole 43. As shown in FIG. 3, the regulating member 45 is supported such that it can be slightly moved toward the regulating member 44 (the direction of an arrow C in FIG. 3) by an air cylinder 47 fixed to the inner frame 42. Note that FIG. 3 shows the regulating members 44 and 45 only partly.

Upon insertion from the elongated hole 43, one side of the new plate 11 abuts against the regulating member 44, and the new plate 11 is moved in a direction perpendicular to the direction of the surface of the new plate 11 by an oscillating device (to be described later), so as to be located between the two regulating members 44 and 45. After that, the air cylinder 47 is driven to move the regulating member 45 toward the regulating member 44, so that the two regulating members 44 and 45 position the new plate 11 in the widthwise direction. The space between the two regulating members 44 and 45 forms a plate storing portion 48.

[Upper Oscillating Device]

As shown in FIG. 3, a shaft 51 horizontally extends between the upper ends of the inner frames 41 and 42. The upper ends of a pair of support plates 52 formed of band-like strip pieces are pivotally supported by the shaft 51, as shown in FIG. 4. The pair of support plates 52 extend to near the lower end of the upper loader 20. A large number of oscillating wheels 53 are rotatably attached to the pair of support plates 52. The new plate 11 inserted from the elongated hole 43 and supported by bars 78 (to be described later) comes into contact with the oscillating wheels 53.

A pair of air cylinders 55 are fixed inside the lower portions of the inner frames 41 and 42, respectively, as shown in FIG. 3. One end of each of levers 56 is attached to the rod end of the corresponding air cylinder 55. The other end of each lever 56 is fixed to a shaft 57 rotatably supported between the inner frames 41 and 42. When the rods of the air cylinders 55 move forward/backward, the shaft 57 pivots clockwise/counterclockwise.

As shown in FIG. 4, the proximal ends of a pair of levers 58 are fixed to the shaft 57. An elongated hole 59 is formed in the pivot end of each lever 58. A shaft 60 extending between the inner frames 41 and 42 is rotatably supported between the elongated holes 59 of the pair of levers 58 through bearings. One end of each of a plurality of levers 61 is fixed to the shaft 60, and the other end of each lever 61 rotatably supports a corresponding press wheel 62. The lower ends of the support plates 52 are fixed to the shaft 60 through plates 63.

In this arrangement, upon backward movement of the rods of the air cylinders 55, the shaft 57 pivots counterclockwise in FIG. 4. Thus, the levers 58 pivot together with the shaft 57 counterclockwise about the shaft 57 as the pivot center. Upon pivot motion of the levers 58, the support plates 52 pivot clockwise in FIG. 4 about the shaft 51 as the pivot center to move the oscillating wheels 53 in the direction of an arrow D. Hence, the new plate 11 moves between the regulating members 44 and 45 as it is supported by the oscillating wheels 53.

Upon movement of the lower ends of the support plates 52 in the direction of the arrow D, the levers 61 also move in the direction of the arrow D through the shaft 60. Thus, the press wheels 62 press a leading edge or leading edge bent portion 11*a* of the new plate 11 in the direction of the arrow D.

[New Plate Support Means]

Rodless air cylinders 70 are fixed inside the upper portions of the inner frames 41 and 42, as shown in FIG. 3. When the air cylinders 70 are driven, moving elements 71 move vertically. A movable rod 72 extends between the inner frames 41 and 42. The two ends of the movable rod 72 are connected to the moving elements 71 through connecting elements 71*a*, respectively. Upon movement of the moving elements 71, the movable rod 72 moves vertically together with the moving elements 71 as it is guided by a pair of guide rods 73.

A pair of bases 75 are fixed to the movable rod 72. As shown in FIG. 4, a press portion 75*a* having an inverted-L-shaped section is fixed to each base 75. As shown in FIG. 3, support members 77 are rotatably supported by shafts 76 horizontally extending on the bases 75, respectively. The bars 78 horizontally extending between the inner frames 41 and 42 are fixed to the support members 77, respectively.

As shown in FIG. 4, stopper pins 79 engaging with the support members 77 vertically extend on the bases 75, respectively. The stopper pins 79 regulate the support members 77 from falling down due to their own weights. This holds the support members 77 in a horizontally advanced state in the plate storing portion 48.

As shown in FIG. 3, square ring-like locking members 81 vertically extend on a rod 82 horizontally extending between the inner frames 41 and 42 to correspond to the support members 77. In this arrangement, when the moving elements 71 of the air cylinders 70 move downward and the support members 77 also move downward, the leading edge bent portion 11*a* of the new plate 11 abuts against a press roller 110 (to be described later), and a distal end 11*c* of the new plate 11 abuts against the upper plate cylinder 6A. After that, the support members 77 abut against the locking members 81, respectively. When the support members 77 further move downward, they pivot counterclockwise about the shafts 76 as the center against their own weights, as shown in FIG. 4.

Thus, the bars 78 are retreated from the plate storing portion 48, and disengage from a trailing edge bent portion 11*b* of the new plate 11. After that, the press portions 75*a* press the trailing edge bent portion 11*b* of the new plate 11, so that the leading edge bent portion 11*a* can be inserted in a groove portion 132 in the upper plate cylinder 6A. More specifically, the leading edge bent portion 11*a* of the new plate 11 abuts against the press roller 110. Simultaneously, the pressing force of the press roller 110 urges the distal end 11*c* of the leading edge bent portion 11*a* of the new plate 11 against the outer surface of the upper plate cylinder 6A.

[Plate Removal/Supply Switching Guide Plate]

As shown in FIG. 3, a pair of air cylinders 90 are arranged inside the centers of the inner frames 41 and 42, respectively, in the vertical direction. One end of a lever 91 is pivotally mounted to the rod end of the corresponding air cylinder 90. The levers 91 are pivotally supported by shafts 92 perpendicularly extending from the inner frames 41 and 42, respectively. As shown in FIG. 4, a plate removal/supply switching guide plate 93 is attached to the other end of each lever 91.

In this arrangement, when the rods of the air cylinders 90 move backward, the plate removal/supply switching guide plate 93 pivots in the direction of the arrow D about the shafts 92 as the pivot center, as indicated by a broken line in FIG. 4. Thus, the new plate 11 can be inserted in the groove portion 132 of the upper plate cylinder 6A. When the rods of the air cylinders 90 move forward, the plate removal/supply switching guide plate 93 pivots in a direction opposite to the direction of the arrow D about the shafts 92 as the pivot center. Thus, the old plate can be removed from the upper plate cylinder 6A. The removed old plate passes between the plate removal/supply switching guide plate 93 and a plate removing guide 94.

[Swing Motion of Upper Loader]

As shown in FIG. 3, the pair of outer frames 22 and 23 swingably support the upper loader 20 through support shafts 100, respectively. The cylinder ends of a pair of air cylinders 101 are pivotally supported inside the outer frames 22 and 23, respectively, and the rod ends of rods 102 are pivotally mounted on the inner frames 41 and 42, respectively. In this arrangement, when the rods 102 of the air cylinders 101 move forward, the upper loader 20 are tilted, as indicated by the alternate long and short dashed line in FIG. 1, and the lower end of the upper loader 20 is positioned at the plate supply position close to the outer surface of the upper plate cylinder 6A. When the rods 102 of the air cylinders 101 move backward, the upper loader 20 is positioned at the standby position in the vertical state, as indicated by the solid line.

[Press Roller]

The press roller 110 will be described with reference to FIGS. 8 to 10C. The press roller 110 inserts the leading edge bent portion 11*a* of the new plate 11 into a plate gripping portion 8A of the upper plate cylinder 6A and mounts the new plate 11 to be in tight contact with the outer surface of the upper plate cylinder 6A.

Figure 9:
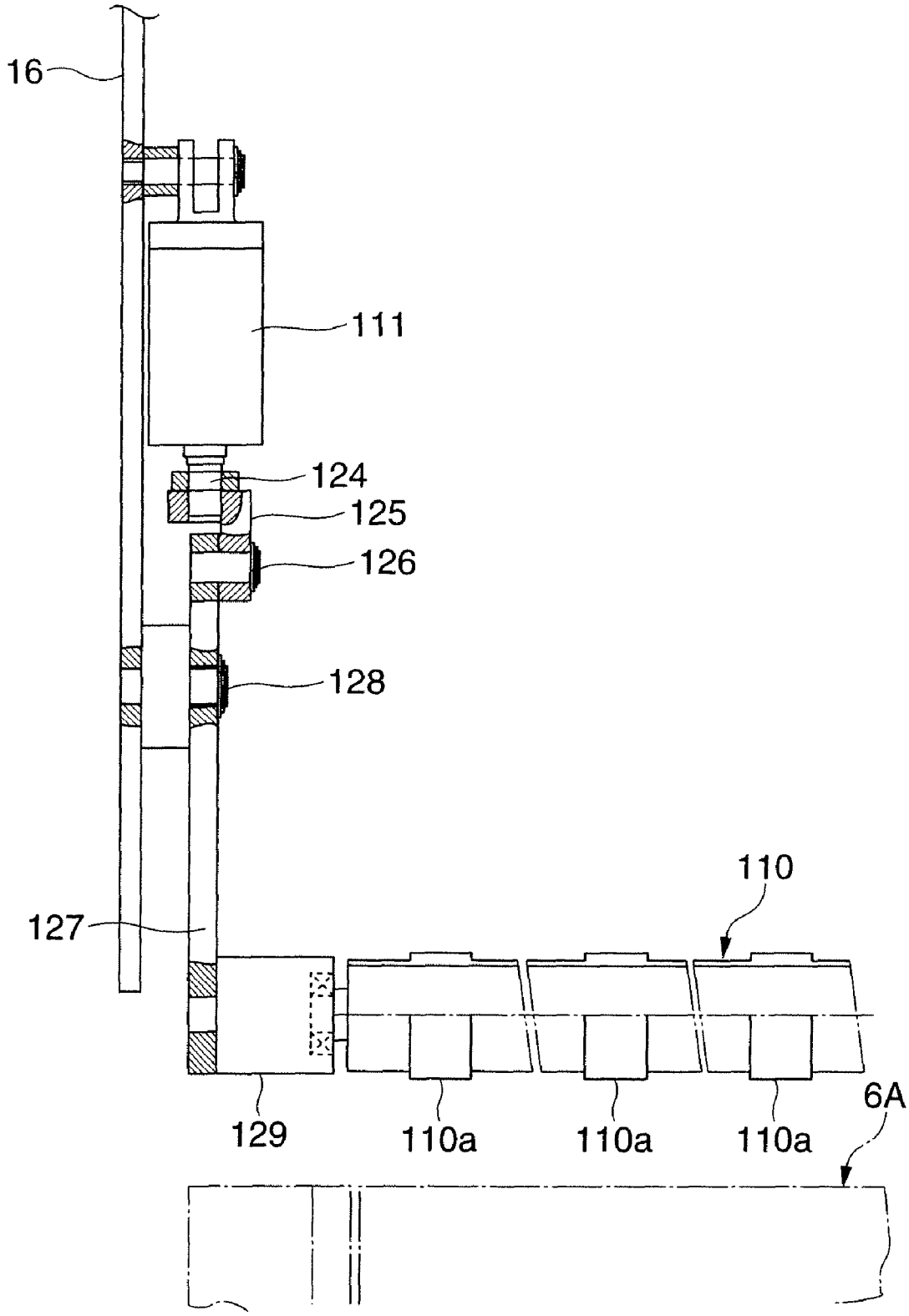
FIG. 9 is a partially sectional developed front view of the main part of the plate inserting apparatus shown in FIG. 6.

As shown in FIG. 9, the cylinder end of an air cylinder 111 is pivotally supported by a frame 16 of the upper loader 20. Air is selectively supplied to the end- and rod-side ports of the air cylinder 111 through a solenoid valve, and a pressure adjusting regulator which sets the pressure of air from a pump to high and low pressures. This can switch the pressing force of the press roller 110, generated by the air cylinder 111, with respect to the outer surface of the upper plate cylinder 6A.

Figure 10B:
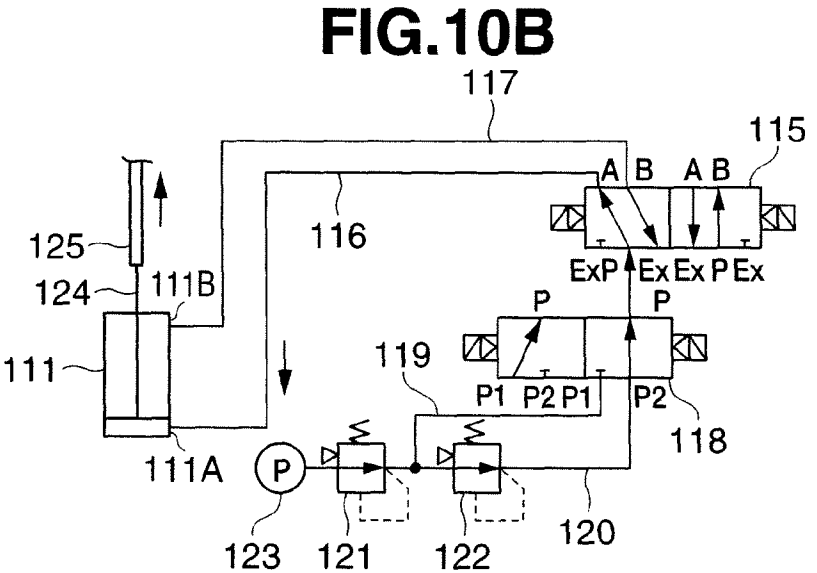
FIGS. 10A to 10C are circuit diagrams of an air supply device in the respective modes for supplying air to an air cylinder which switches the pressing force of a press roller with respect to the outer surface of a plate cylinder.

This will be described with reference to FIGS. 10A to 10C. An air cylinder driving solenoid valve 115 to drive the air cylinder 111 has three ports, i.e., ports A, B, and P. Of the three ports, the port A is connected to a side to move a rod 124 of the air cylinder 111 forward, i.e., an end-side port 111A, through an air tube 116. The port B is connected to a side to move the rod 124 of the air cylinder 111 backward, i.e., a rod-side port 111B, through an air tube 117. The port P is connected to a port P of a switching solenoid valve 118 (to be described later).

The solenoid valve 115 can be switched between two modes, a mode in which the port A is connected to the port P and the port B is opened to the atmospheric pressure, and a mode in which the port B is connected to the port P and the port A is opened to the atmospheric pressure.

The switching solenoid valve 118 has three ports, i.e., ports P, P1, and P2. The port P1 is connected to a regulator 121 (to be described later) through an air tube 119. The port P2 is connected to a regulator 122 (to be described later) and the regulator 121 through an air tube 120. The switching solenoid valve 118 can be switched between two modes, i.e., a mode in which the port P1 is connected to the port P and the port P2 is closed, and a mode in which the port P1 is closed and the port P2 is connected to the port P.

The pressure adjusting regulator 121 is a pressure reducing valve which sets the pressure of air discharged from a discharge pump 123 to high pressure and supplies it to the port P1 of the switching solenoid valve 118. The pressure adjusting regulator 122 is a pressure reducing valve which is connected to the discharge side of the regulator 121 and sets the pressure to a relatively low pressure and supplies it to the port P2 of the switching solenoid valve 118.

Figure 8:
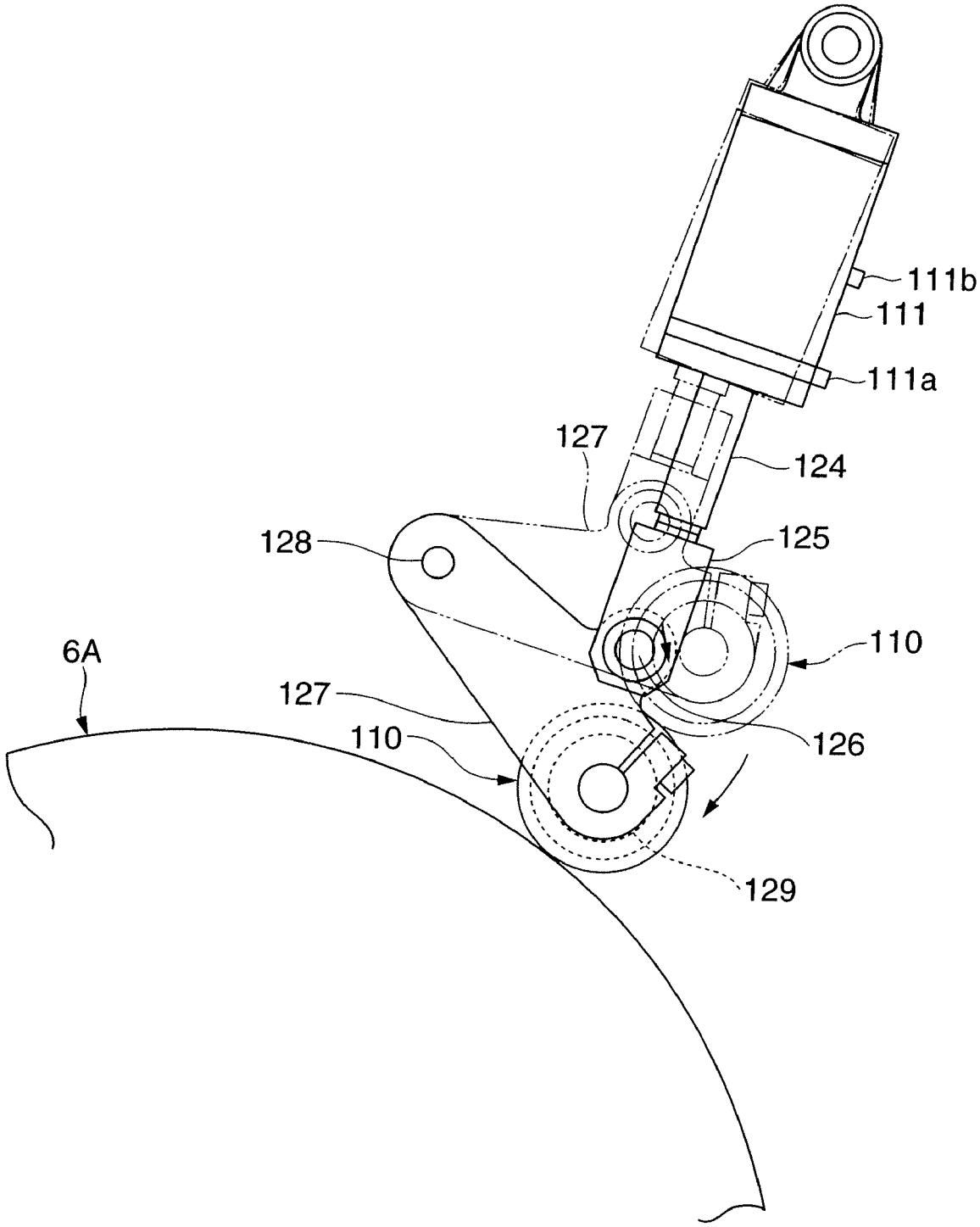
FIG. 8 is an enlarged side view showing the main part of the plate inserting apparatus shown in FIG. 6.

As shown in FIG. 8, the air cylinder 111 is provided with an autoswitch 111*a* which detects the moving end limit of the rod 124 that has moved forward, and an autoswitch 111*b* which detects the moving end limit of the rod 124 that has moved backward.

One end of a moving element 125 is fixed to the distal end of the rod 124. Almost the center of a lever 127 is pivotally mounted on the other end of the moving element 125 through a pin 126. One end of the lever 127 is swingably, pivotally supported through a shaft 128 extending vertically on the frame 16. The other end of the lever 127 rotatably supports the press roller 110 through a bearing holder 129. A plurality of large-diameter portions 110*a* are formed on the outer surface of the press roller 110 equidistantly in the axial direction.

In this arrangement, assume a state in which the press roller 110 is spaced apart from the outer surface of the upper plate cylinder 6A, as indicated by an alternate long and two short dashed line in FIG. 8. In this state, when the rod 124 of the air cylinder 111 moves forward, the lever 127 pivots clockwise about the shaft 128 as the pivot center. Accordingly, the large-diameter portions 110*a* of the press roller 110 oppose the outer surface of the upper plate cylinder 6A.

[Plate Gripping Portion]

The plate gripping portion 8A will be described with reference to FIG. 11. An elongated groove-like groove portion 132 extends in the outer surface of the upper plate cylinder 6A in the axial direction, and a winding rod 133 is pivotally inserted to extend in the groove portion 132. The winding rod 133 has a kerf 134 with an almost V-shaped section, which extends in the axial direction. A retainer 136 positioned by a pin (not shown) is accommodated in the kerf 134. The two ends of the retainer 136, i.e., a plate leading edge holding end 136*a* and plate trailing edge holding end 136*b* are formed by bending in the same direction.

Figure 11:
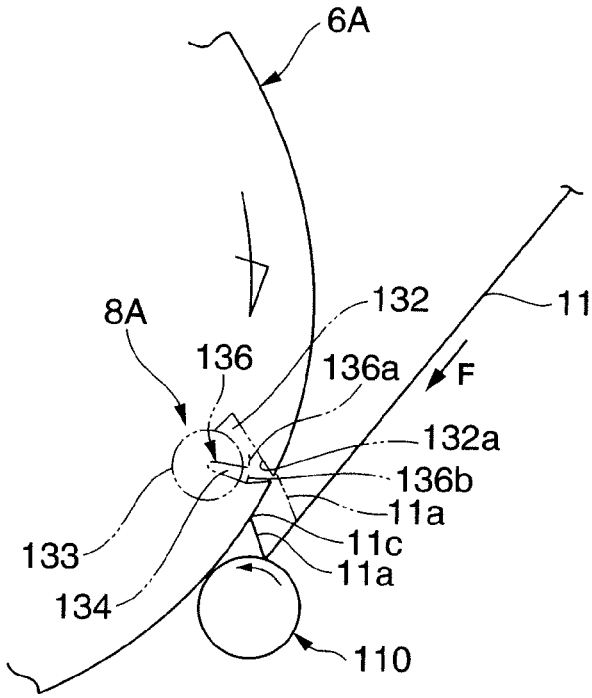
FIG. 11 is an enlarged view of the main part showing a state of inserting the leading edge bent portion of a new plate into the groove portion of the plate cylinder.

In this arrangement, when the winding rod 133 is pivoted clockwise in FIG. 11 in advance, the leading edge bent portion 11*a* of the new plate 11 inserted from the groove portion 132 is inserted between a wall surface 132*a* of the groove portion 132 and the plate leading edge holding end 136*a* of the retainer 136. After that, when the upper plate cylinder 6A is rotated by one revolution, the trailing edge bent portion 11*b* of the new plate 11 is inserted in the groove portion 132 to engage with the plate trailing edge holding end 136*b* of the retainer 136. Then, when the winding rod 133 is pivoted counterclockwise in FIG. 11, the leading edge bent portion 11*a* of the new plate 11 is holded between the wall surface 132*a* of the groove portion 132 and the plate leading edge holding end 136*a* of the retainer 136, so the new plate 11 is mounted on the upper plate cylinder 6A.

[Braking Unit]

Figure 5:
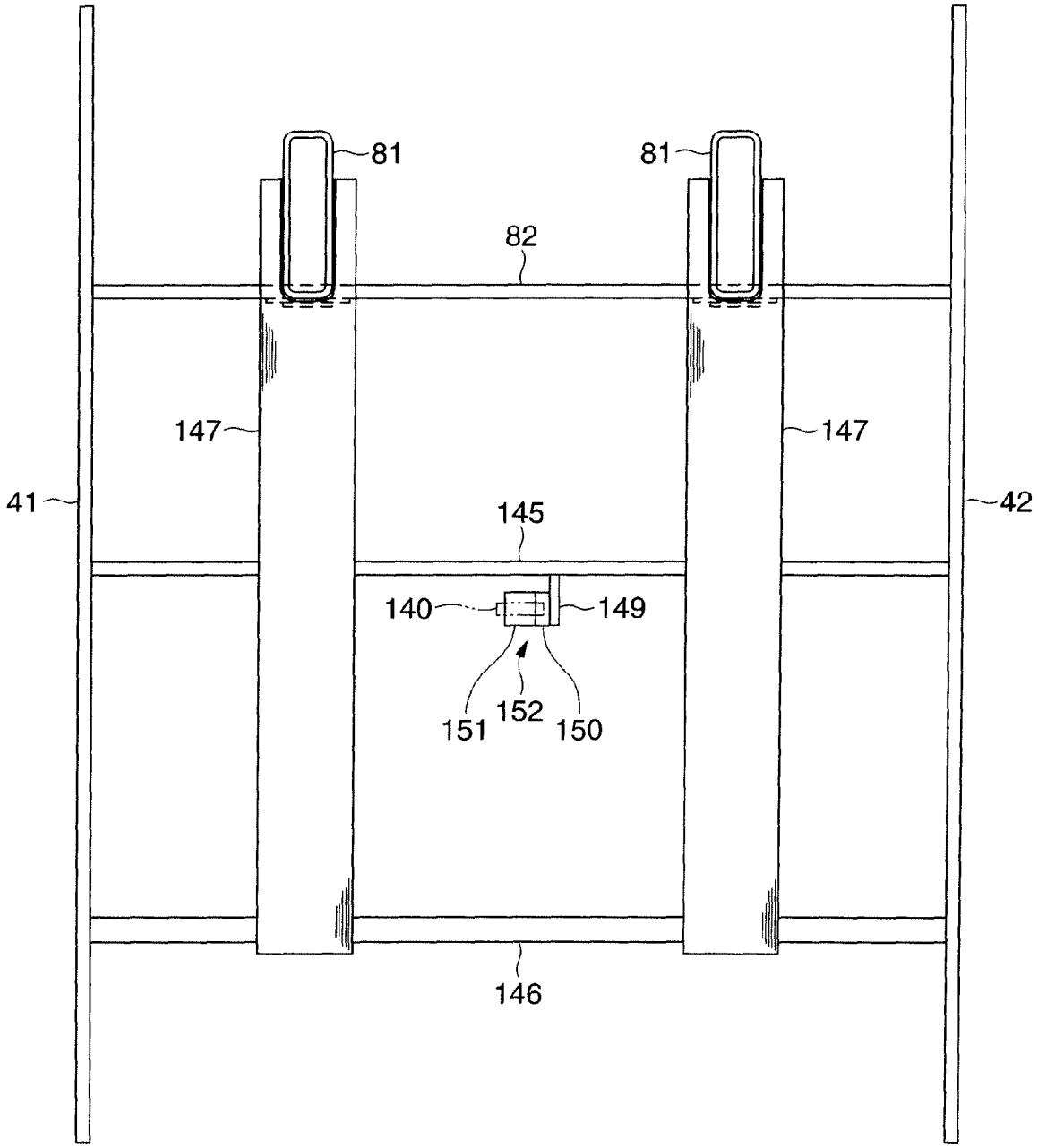
FIG. 5 is a front view showing the main part of a plate inserting apparatus shown in FIG. 4.

A braking unit will be described with reference to FIGS. 3 to 7. A stay 141 extending between the pair of support plates 52 supports a wheel 140, as shown in FIG. 3. As shown in FIGS. 4 and 5, stays 145 and 146 extend between the pair of inner frames 41 and 42, and the two ends of each of a pair of plate guides 147 are fixed to one stay 146 and the rod 82, respectively.

A plate holding pad detaching air cylinder 150 (actuator) is fixed to the other stay 145 through a support plate 149. A pad 151 movable forward/backward and corresponding to the wheel 140 is attached to the rod of the air cylinder 150. In this arrangement, when the rods of the air cylinders 55 move backward, the support plates 52 move in the direction of the arrow D in FIG. 4, and the wheel 140 also moves together with the oscillating wheels 53 in the direction of the arrow D. In this state, when the rod of the air cylinder 150 moves forward, the new plate 11 is held by the pad 151 and wheel 140, as indicated by an alternate long and two short dashed line in FIG. 6. Thus, the new plate 11 is braked and regulated from moving downward in FIG. 6. Hence, the pad 151 and wheel 140 constitute a braking unit 152 which brakes the new plate 11 and regulates its movement.

[Plate Changing Operation of Upper Plate Cylinder]

First, the air cylinder 26 is driven to move the upper loader 20 from the separate position (the alternate long and two short dashed line in FIG. 1) in the direction of the arrow A and position it at the standby position (the solid line) close to the printing unit 1.

With the upper loader 20 being located at the standby position, the new plate 11 is moved in the direction of the arrow C as shown in FIG. 2 so that it is inserted from the elongated hole 43 in the inner frame 42. Then, as shown in FIG. 4, the trailing edge bent portion 11*b* of the new plate 11 is hung on the bars 78. Thus, the new plate 11 is supported by the bars 78 as it hangs with its own weight.

Subsequently, upon forward movement of the rods 102 of the air cylinders 101, the upper loader 20 is tilted and positioned at the plate supply position (the alternate long and short dashed line in FIG. 1). Then, as shown in FIG. 4, upon forward movement of the rods of the air cylinders 90, the plate removal/supply switching guide plate 93 moves in a direction opposite to the direction of the arrow D and is positioned at the plate removal position.

In this state, when the winding rod 133 at the plate gripping portion 8A is pivoted to disengage the trailing edge bent portion of the old plate from the upper plate cylinder 6A, the trailing edge bent portion of the old plate ejects from the outer surface of the upper plate cylinder 6A. Subsequently, upon rotation of the upper plate cylinder 6A, the trailing edge bent portion of the old plate passes between the plate removing guide plate 94 and plate removal/supply switching guide plate 93. Then, the upper plate cylinder 6A rotates, so that the old plate is recovered in the upper plate removal/recovery unit 30.

Then, upon forward movement of the rod 124 of the air cylinder 111, the press roller 110 opposes the outer surface of the upper plate cylinder 6A, as shown in FIG. 8. In this state, when the rods of the air cylinders 90 move backward, the plate removal/supply switching guide plate 93 moves in the direction of the arrow D and is positioned at the plate supply position indicated by the broken line, as shown in FIG. 4. At this time, the new plate 11 is inserted from the elongated hole 43 and hung on the bars 78 such that its one end side abuts against the regulating member 44.

In this state, when the rods of the air cylinders 55 move backward, the support plates 52 pivot clockwise about the shaft 51 as the pivot center, as shown in FIG. 4. Hence, the oscillating wheels 53 and wheel 140 move in the direction of the arrow D, and accordingly the new plate 11 moves in the direction of the arrow D and is positioned between the regulating members 44 and 45. At this time, as the lower ends of the support plates 52 move in the direction of the arrow D, the levers 61 also move in the direction of the arrow D through the shaft 60. Thus, the press wheels 62 press the leading edge bent portion 11*a* of the new plate 11 in the direction of the arrow D and position it to correspond to the plate gripping portion 8A of the upper plate cylinder 6A.

Simultaneously, upon driving the air cylinder 47, the regulating member 45 moves toward the regulating member 44, so the regulating members 44 and 45 position the new plate 11 in the widthwise direction.

Subsequently, when the moving elements 71 of the air cylinders 70 move downward and the support members 77 also move downward, the leading edge bent portion 11*a* of the new plate 11 abuts against the outer surface of the press roller 110, as shown in FIG. 11. At this time, as shown in FIG. 10A, the solenoid valve 115 is set in the mode in which its port P is connected to the port A and its port B is opened to the atmospheric pressure. Also, upon actuating the other solenoid of the switching solenoid valve 118, so that the switching solenoid valve 118 is switched to the mode in which its port P is connected to the port P2.

The pressure of air supplied to the port P2 by the regulators 121 and 122 is set to be relatively lower than that of air supplied to the port P1 by the regulator 121. Hence, air with a low pressure is supplied to the port 111A of the air cylinder 111, so that the pressing force of the press roller 110, generated by the air cylinder 111, with respect to the outer surface of the upper plate cylinder 6A decreases.

Figure 6:
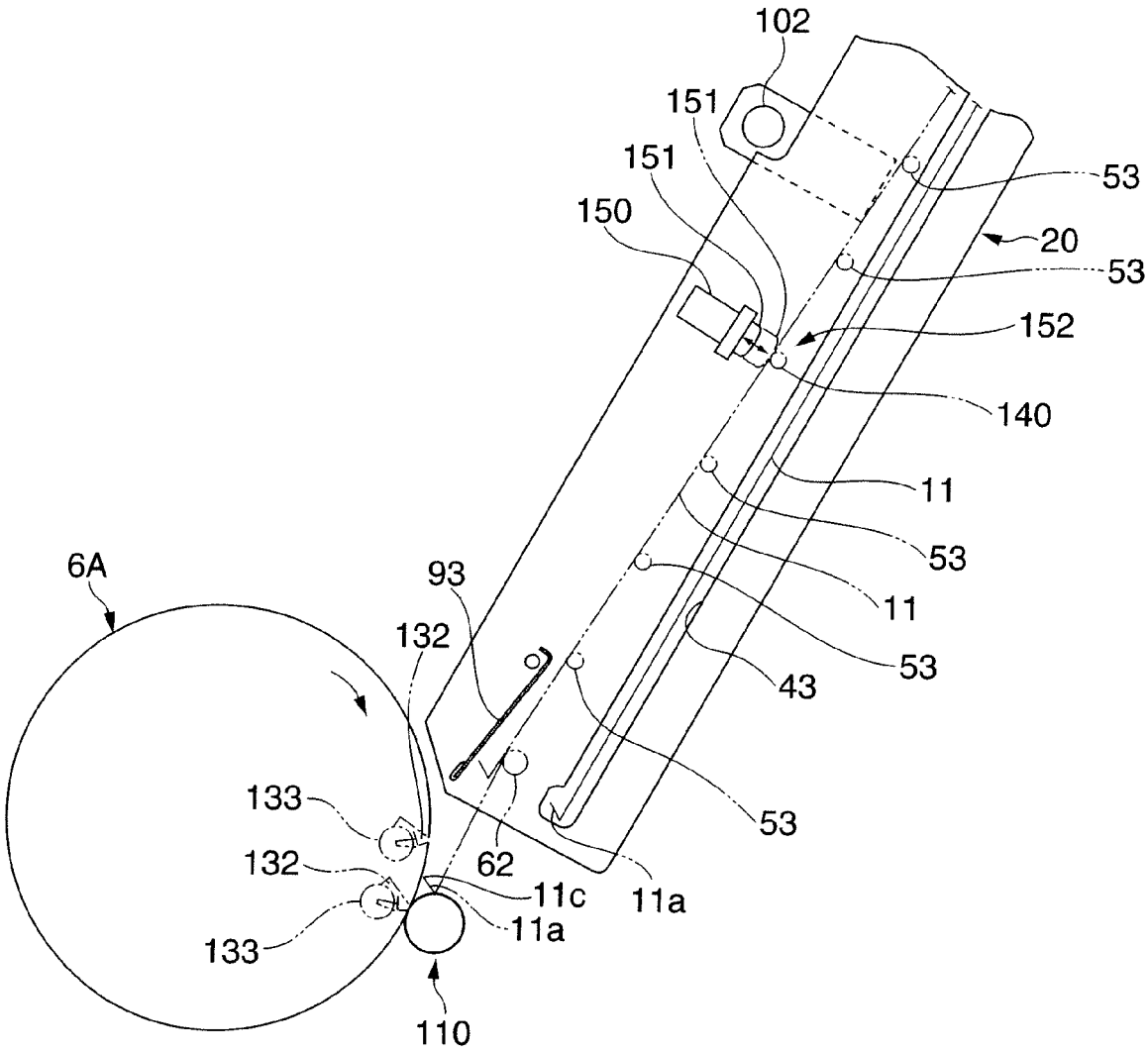
FIG. 6 is a side view showing the main part of the plate inserting apparatus shown in FIG. 4.
Figure 7:
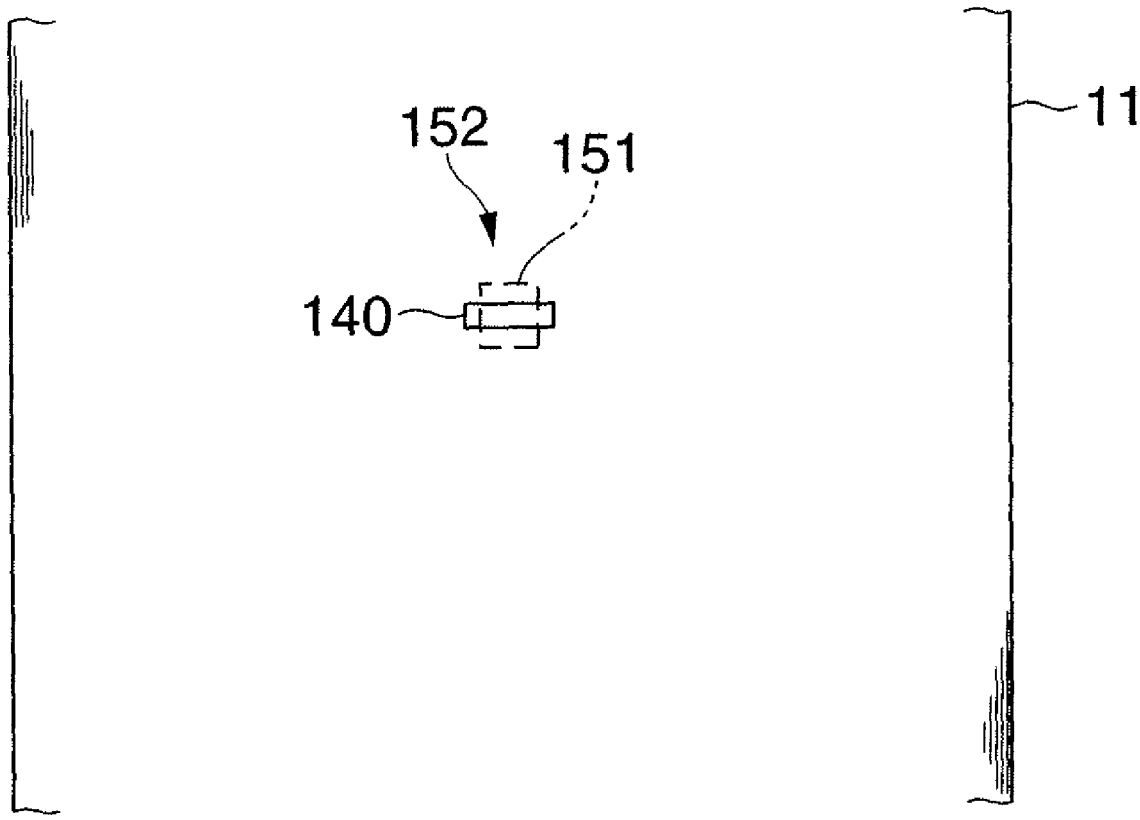
FIG. 7 is a view for explaining the positional relationship between a pad and wheel shown in FIG. 4.

At this time, upon forward movement of the rod of the air cylinder 150, the pad 151 and wheel 140 hold the new plate 11, as indicated by the alternate long and two short dashed line in FIG. 6. In this manner, when the leading edge bent portion 11*a* of the new plate 11 abuts against the outer surface of the press roller 110, as shown in FIG. 11, the pad 151 and wheel 140 hold the new plate 11 to brake (regulate) its downward movement in FIG. 11 (a direction indicated by an arrow F). A solid line in FIG. 11 indicates the leading edge bent portion 11*a* during braking, and an alternate long and two short dashed line in FIG. 11 indicates the leading edge bent portion 11*a* before the rotation of the upper plate cylinder 6A and before braking is started (a state in which baking is canceled).

Therefore, even if the press roller 110 rotates counterclockwise upon clockwise pivot motion of the upper plate cylinder 6A, the leading edge bent portion 11*a* of the new plate 11 will not be caught between the upper plate cylinder 6A and press roller 110. Thus, the leading edge bent portion 11*a* of the new plate 11 will no longer be crushed by the upper plate cylinder 6A and press roller 110 to allow the new plate 11 usable. Consequently, plates will not be wasted, thus improving the economical efficiency. Also, the new plate need not be remounted in the plate changing device, which improves the working efficiency.

Then, the leading edge bent portion 11*a* of the new plate 11 abuts against the upper plate cylinder 6A and press roller 110, as shown in FIG. 11. After the new plate 11 stops moving downward, the support members 77 abut against the upper ends of the locking members 81. Subsequently, when the support members 77 move downward, they pivot counterclockwise about the shafts 76 as the center, and the bars 78 are retreated from the plate storing portion 48.

Figure 12:
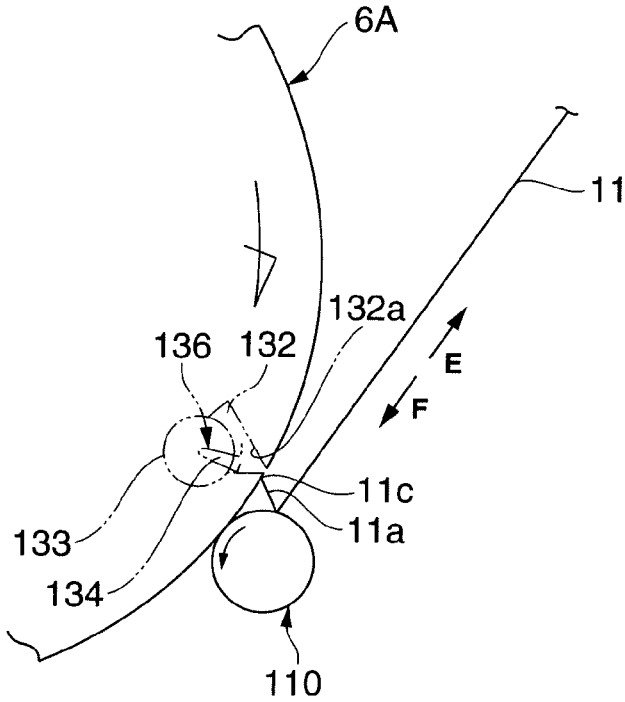
FIG. 12 is an enlarged view of the main part showing a state immediately before inserting the leading edge bent portion of the new plate into the groove portion of the plate cylinder.

After that, the upper plate cylinder 6A pivots clockwise, and the leading edge bent portion 11*a* of the new plate 11 opposes the inserting position for the groove portion 132 of the upper plate cylinder 6A, as shown in FIG. 12. At this time, the rod of the air cylinder 150 of the braking unit 152 moves backward, so that the new plate 11 is disengaged from the pad 151 and wheel 140, as indicated by a solid line in FIG. 6. Thus, the new plate 11 released from the braking unit 152 is not pulled in the direction of an arrow E in FIG. 12, and the press roller 110 inserts the leading edge bent portion 11*a* into the groove portion 132 smoothly and reliably.

Figure 13:
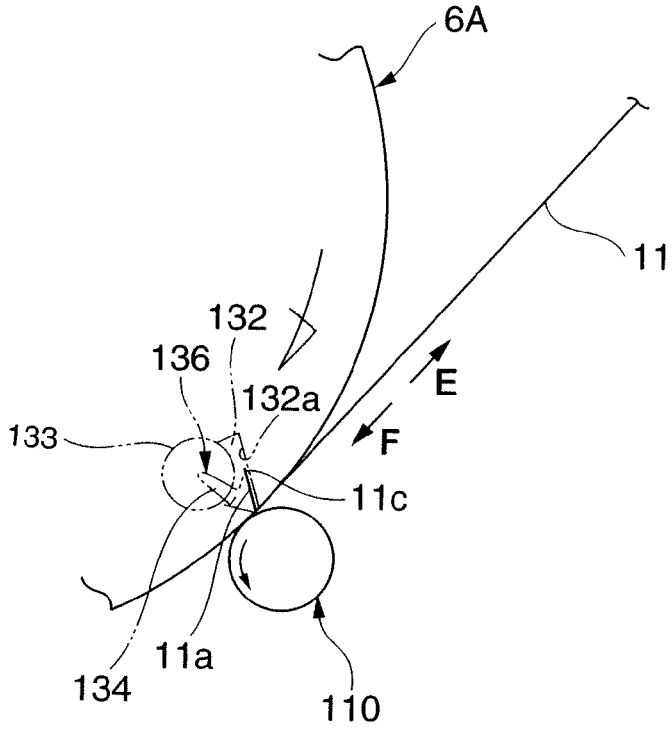
FIG. 13 is an enlarged view of the main part showing a state in which the leading edge bent portion of the new plate is inserted in the groove portion of the plate cylinder.
Figure 14:
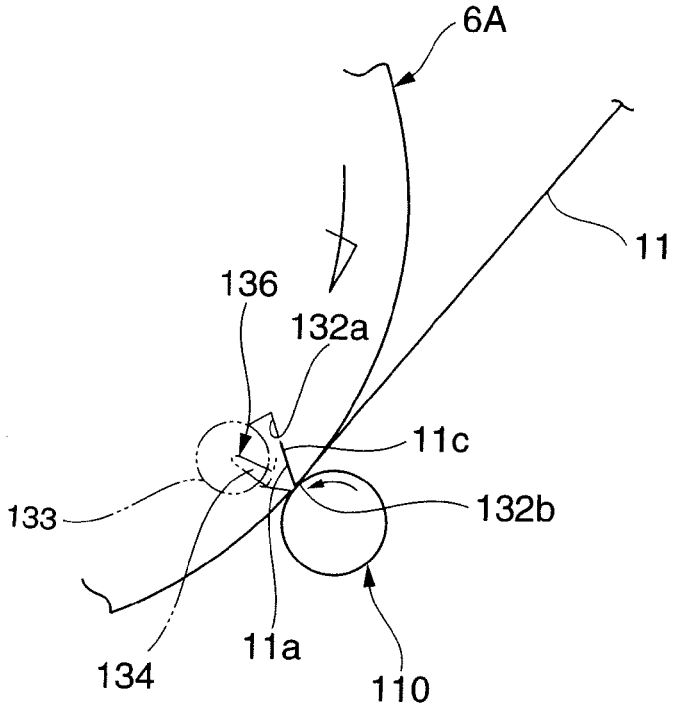
FIG. 14 is an enlarged view of the main part showing a state in which the leading edge bent portion of the new plate inserted in the groove portion of the plate cylinder is in tight contact with the wall surface of the groove portion.
Figure 15:
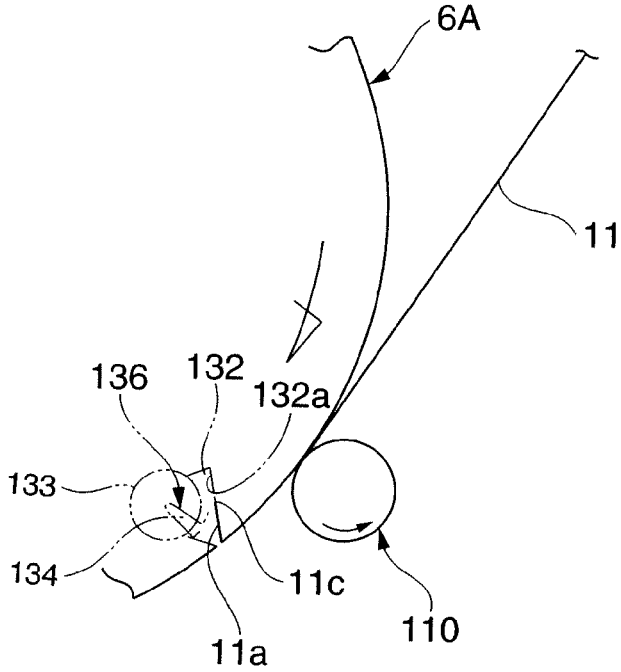
FIG. 15 is an enlarged view of the main part showing a state in which the new plate is in tight contact with the outer surface of the plate cylinder.

As shown in FIG. 13, when the leading edge bent portion 11*a* is inserted in the groove portion 132, the rod of the air cylinder 150 of the braking unit 152 moves forward again. Thus, the new plate 11 is held by the pad 151 and wheel 140, and its movement downward in FIG. 13 (the direction of the arrow F) is braked. In this state, when the upper plate cylinder 6A slightly pivots clockwise, the braking unit 152 regulates the new plate 11 from moving in the direction of the arrow F. Consequently, the new plate 11 is pulled in the direction of an arrow E, and the leading edge bent portion 11*a* comes into tight contact with the wall surface 132*a* of the groove portion 132, as shown in FIG. 14.

After that, when the pad 151 of the air cylinder 150 of the braking unit 152 moves backward, the new plate 11 is disengaged from the pad 151 and wheel 140. Simultaneously, as shown in FIG. 10B, one solenoid of the solenoid valve 115 is actuated, so that the solenoid valve 115 is switched to the mode in which the port P is connected to the port A and the port B is opened to the atmospheric pressure. Also, one solenoid of the switching solenoid valve 118 is actuated, so that the switching solenoid valve 118 is switched to the mode in which the port P is connected to the port P1.

The pressure of air supplied to the port P1 by the regulator 121 is set to be relatively higher than that of air supplied to the port P2 by the regulators 121 and 122. Hence, air with a relatively high pressure is supplied to the end-side port 111A of the air cylinder 111, so that the pressing force of the press roller 110, generated by the air cylinder 111, with respect to the outer surface of the upper plate cylinder 6A increases.

Figure 16:
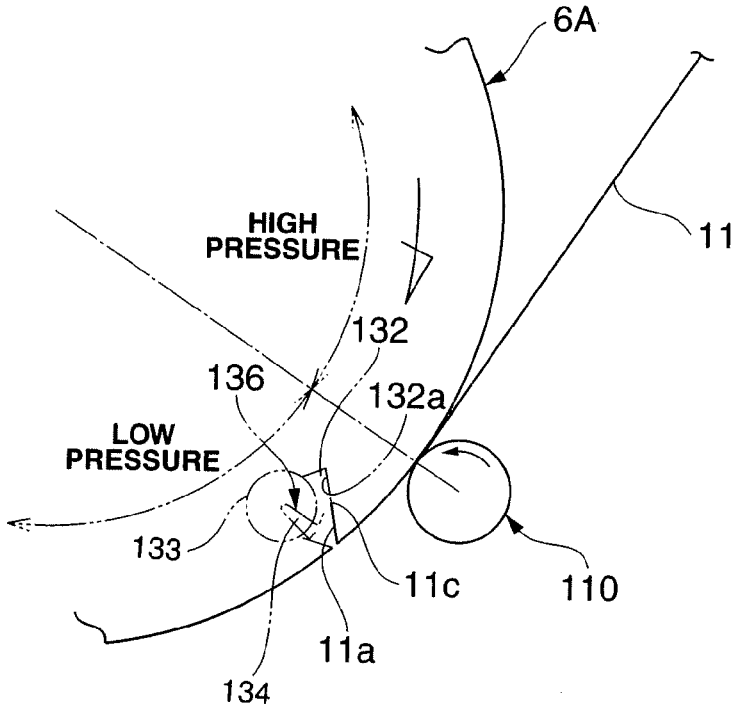
FIG. 16 is an enlarged view of the main part for explaining the relationship between the pressing force of the press roller which brings the new plate into tight contact with the outer surface of the plate cylinder and the phase of the outer surface of the plate cylinder.

The range in which the pressing force of the press roller 110, generated by the air cylinder ill, with respect to the outer surface of the upper plate cylinder 6A is small is set to cover up to a portion where the press roller 110 has passed the groove portion 132, as shown in FIG. 16. Hence, if the leading edge bent portion 11*a* of the new plate 11 is not correctly inserted in the groove portion 132, the autoswitch 111*a* can detect suspension of the press roller 110 from the outer surface of the upper plate cylinder 6A as a plate mounting error.

Once the press roller 110 passes the groove portion 132, the pressing force of the press roller 110 with respect to the outer surface of the upper plate cylinder 6A is set relatively large. This allows the new plate 11 to be mounted on the outer surface of the upper plate cylinder 6A in tight contact with it with the leading edge bent portion 11*a* being kept in tight contact with the wall surface 132*a* of the groove portion 132. As a result, a plate mounting error can be prevented.

Once the leading edge bent portion 11*a* of the new plate 11 is inserted in the groove portion 132 of the upper plate cylinder 6A, the pad 151 of the air cylinder 150 of the braking unit 152 moves backward. Hence, the pad 151 is separated from the wheel 140, and the trailing edge bent portion 11*b* of the new plate 11 will not interfere with the pad 151.

Figure 10C:
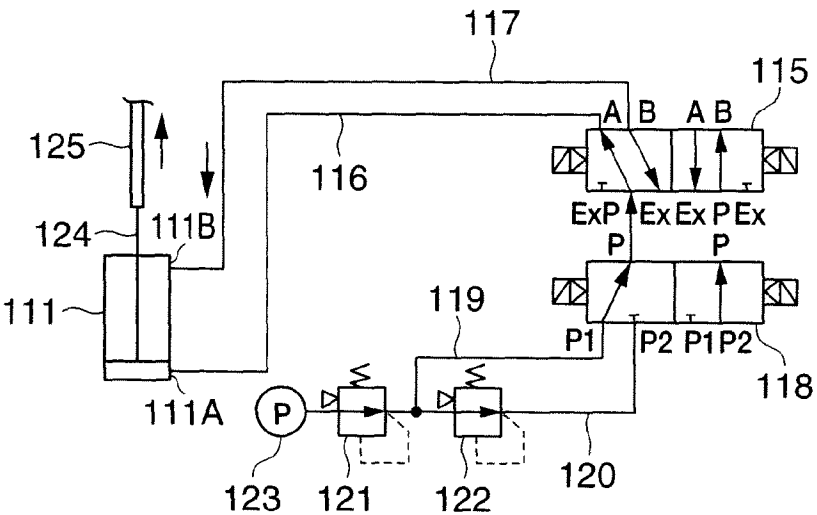
Figure 10A:
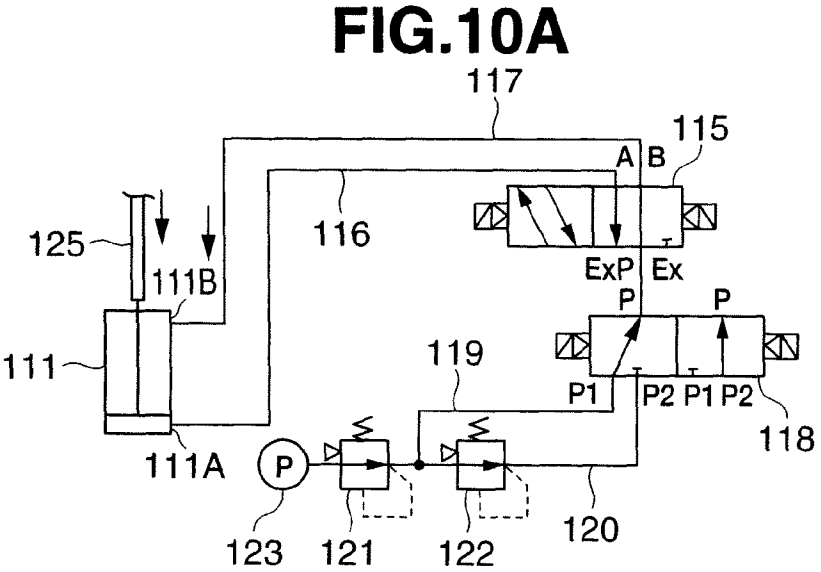

When the upper plate cylinder 6A rotates almost by one revolution and the new plate 11 is mounted on the outer surface of the upper plate cylinder 6A, the other solenoid of the solenoid valve 115 is actuated, as shown in FIG. 10C. Thus, the solenoid valve 115 is switched to the mode in which the port P is connected to the port B and the port A is opened to the atmospheric pressure. Also, one solenoid of the switching solenoid valve 118 is actuated, so the switching solenoid valve 118 is switched to the mode in which the port P is connected to the high-pressure port P1. Consequently, comparatively high-pressure air is supplied to the port 111B of the air cylinder 111. Thus, the rod 124 of the air cylinder 111 moves backward, and the press roller 110 is separated from the outer surface of the upper plate cylinder 6A.

Figure 17:
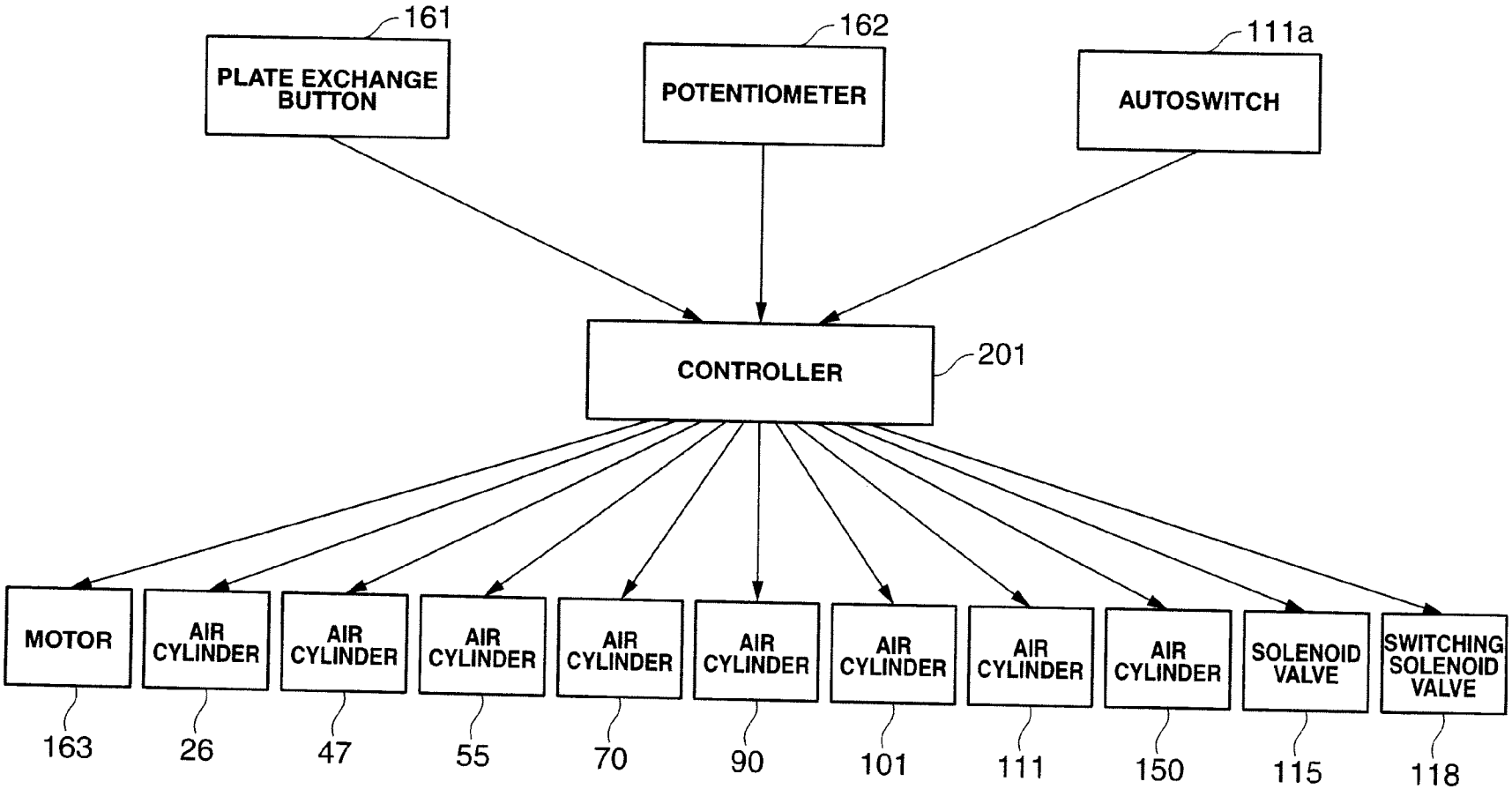
FIG. 17 is a block diagram showing the electrical arrangement of the plate inserting apparatus shown in FIG. 4.

FIG. 17 shows the electrical arrangement of the plate inserting apparatus described above. As shown in FIG. 17, the plate inserting apparatus according to this embodiment includes, in addition to the air cylinders 26, 47, 55, 70, 90, 101, 111, and 150, solenoid valve 115, switching solenoid valve 118, and autoswitch 111*a* described above, a plate exchange button 161, potentiometer 162, printing press driving motor 163, and controller 201. Upon manipulation of the plate exchange button 161 by the operator, plate exchange start is instructed to the controller 201. The controller 201 controls the air cylinders 26, 47, 55, 70, 90, 101, 111, and 150, solenoid valve 115, switching solenoid valve 118, and motor 163 on the basis of outputs from the plate exchange button 161, potentiometer 162, and autoswitch 111*a*.

Upon rotational driving of the printing press, the potentiometer 162 outputs a rotation phase pulse. The controller 201 detects the rotation phases of the plate cylinders 6A and 6B on the basis of the rotation phase pulse output from the potentiometer 162. Hence, the potentiometer 162 and controller 201 constitute a rotation phase detector which detects the rotation phases of the plate cylinders. The controller 201 turns on and off the air cylinder 150 on the basis of the rotation phase detection result, thus controlling the braking operation and braking cancellation operation of the braking unit 152.

According to this embodiment, the braking unit 152 brakes the new plate 11 after the distal end 11*c* of the new plate 11 abuts against the outer surface of the upper plate cylinder 6A. Alternatively, the new plate 11 may be braked before the leading edge bent portion 11*a* has been inserted in the groove portion 132.

As has been described above, according to the present invention, the new plate is braked when its leading edge bent portion abuts against the outer surface of the press roller. For this reason, the leading edge bent portion will not be caught by the press roller and crushed by the plate cylinder and press roller. Accordingly, the plate will not be wasted, so the economic efficiency improves. Also, remounting of the new plate is unnecessary, thus improving the working efficiency as well.

The braking operation is canceled after the leading edge bent portion of the new plate comes into tight contact with the wall surface of the groove portion of the plate cylinder. Therefore, when the new plate is to be transferred after that in the plate storing portion, the other bent portion of the new plate will not interfere with the braking unit.

The contact pressure of the press roller with respect to the outer surface of the plate cylinder, after the press roller has passed the groove portion of the plate cylinder, is set to be relatively higher than that before the press roller passes the groove portion. Hence, the plate can be mounted to be in tight contact with the outer surface of the plate cylinder with its leading edge bent portion being held in tight contact with the wall surface of the groove portion. This can prevent a plate mounting error.

Since the braking unit is arranged in the plate storing portion, ink or the like will not be attached to the braking unit to degrade the performance of the braking unit. Also, a space to install the braking unit need not be reserved around the plate cylinder.

What is claimed is:

1. A plate inserting apparatus comprising:

a plate cylinder with an outer surface where a plate is to be mounted;

a press roller which is rotatably supported to oppose the outer surface of said plate cylinder and, when a leading edge bent portion of the plate to be supplied to said plate cylinder abuts against said press roller and a distal end of the leading edge bent portion abuts against the outer surface of said plate cylinder, inserts the leading edge bent portion of the plate into a groove portion formed in said plate cylinder upon the rotation of said press roller according to said plate cylinder; and a braking unit which starts a braking operation to the plate when the leading edge bent portion of the plate abuts against said plate cylinder and said press roller and terminates the braking operation to the plate when the leading edge bent portion of the plate is inserted in the groove portion of said plate cylinder, a potentiometer which generates rotational phase pulses as the plate cylinder rotates, and a control unit which detects the rotational phase of said plate cylinder on the basis of the rotational phase pulses generated by said potentiometer to thereby control said braking unit.

2. An apparatus according to claim 1, wherein said braking unit cancels braking of the plate after the leading edge bent portion of the plate comes into tight contact with a wall surface of the groove portion of said plate cylinder.

3. An apparatus according to claim 1, wherein a contact pressure of said press roller with respect to the outer surface of said plate cylinder after said press roller has passed the groove portion of said plate cylinder is set to be relatively larger than that before said press roller has passed the groove portion of said plate cylinder.

4. An apparatus according to claim 1, wherein said braking unit is arranged in a plate storing portion which stores the plate to be supplied.

5. An apparatus according to claim 4, wherein said braking unit is covered in the plate storing portion.

6. An apparatus according to claim 1, wherein said braking unit holds the plate and regulates movement of the plate in a plate inserting direction.

7. An apparatus according to claim 1, wherein said press roller comprises a friction roller which rotates upon rotation of said plate cylinder.

8. A plate inserting apparatus comprising:

a plate cylinder with an outer surface where a plate is to be mounted;

a press roller which is rotatably supported to oppose the outer surface of said plate cylinder and, when a leading edge bent portion of the plate to be supplied to said plate cylinder abuts against said press roller and a distal end of the leading edge bent portion abuts against the outer surface of said plate cylinder, inserts the leading edge bent portion of the plate into a groove portion formed in said plate cylinder under on rotation (with a pressing force) of said plate cylinder; and a braking unit which starts a braking operation when the leading edge bent portion of the plate abuts against said plate cylinder and said press roller and terminates the braking operation when the leading edge bent portion of the plate is inserted in the groove portion of said plate cylinder, a potentiometer which generates rotational phase pulses as the plate cylinder rotates, and a control unit which detects the rotational phase of said plate cylinder on the basis of the rotational phase pulses generated by said potentiometer to thereby control said braking unit, wherein said braking unit holds the plate and regulates movement of the plate in a plate inserting direction, wherein said braking unit comprises a wheel which is rotatably supported (which guides insertion of the plate), and a pad which is movably supported in a direction to come into contact with and separate from said wheel and holds the plate together with said wheel.

9. An apparatus according to claim 8, further comprising an actuator including a rod to which said pad is attached.

* * * * *